US006773513B2

(12) United States Patent
Ludtka

(10) Patent No.: US 6,773,513 B2
(45) Date of Patent: Aug. 10, 2004

(54) METHOD FOR RESIDUAL STRESS RELIEF AND RETAINED AUSTENITE DESTABILIZATION

(75) Inventor: Gerard M. Ludtka, Oak Ridge, TN (US)

(73) Assignee: UT-Battelle LLC, Oak Ridge, TN (US)

( * ) Notice: Subject to any disclaimer, the term of this patent is extended or adjusted under 35 U.S.C. 154(b) by 1 day.

(21) Appl. No.: 10/217,396

(22) Filed: Aug. 13, 2002

(65) Prior Publication Data

US 2004/0031542 A1 Feb. 19, 2004

(51) Int. Cl.[7] ..... C21D 1/04; H01F 1/00

(52) U.S. Cl. ..... 148/108; 148/565; 148/579; 148/679; 148/688; 335/284

(58) Field of Search ..... 148/108, 565, 148/579, 679, 688; 335/284

(56) References Cited

U.S. PATENT DOCUMENTS

| | | | | |
|---|---|---|---|---|
| 1,978,220 A | | 10/1934 | Otte | |
| 3,185,600 A | | 5/1965 | Dullberg | |
| 3,188,248 A | | 6/1965 | Bassett, II | |
| 3,963,533 A | | 6/1976 | Collins | |
| 4,092,184 A | * | 5/1978 | Stucker | 148/103 |
| 4,873,605 A | * | 10/1989 | Drits et al. | 361/143 |
| 4,939,121 A | | 7/1990 | Rybka | |
| 5,096,880 A | | 3/1992 | Rybka | |
| 5,242,512 A | | 9/1993 | Bagley et al. | |
| 5,259,200 A | | 11/1993 | Kamody | |
| 5,772,794 A | * | 6/1998 | Uno et al. | 148/108 |
| 5,885,370 A | * | 3/1999 | Shimotomai et al. | 148/108 |
| 6,144,544 A | * | 11/2000 | Milov et al. | 361/143 |
| 6,291,403 B1 | | 9/2001 | Yamazaki | |
| 6,375,760 B2 | * | 4/2002 | Maruta et al. | 148/108 |
| 2002/0020470 A1 | * | 2/2002 | Okumura et al. | 148/108 |

OTHER PUBLICATIONS

Wu et al., "Micromechanism of residual stress reduction by low frequency alternating magnetic field treatment", Materials Science and Engineering, A328, pp. 133–136, 2002.

H. Conrad et al., "Effect of electric current pulses on fatigue characteristics of polycrystalline copper", Mater.Sci.Eng. A145, p. 1–12, 1991.

Zhoa Yong et al., "Slowing down metal fatigue damage with a magnetic field", Engineering Fracture Mechanics, vol. 46, No. 2, pp. 347–352, 1993.

I. K. Bhat et al., "Possible effects of magnetic fields in fatigue", International Journal of Fatigue, 15, No. 3, pp. 193–197, May 1993.

L. Bao–Tong et al., "Exploration of repairing fatigue damage of steel specimens with magnetic treatment", Scipta Materialia, vol. 40, No. 7, pp. 767–771, 1999.

(List continued on next page.)

*Primary Examiner*—John P. Sheehan
(74) *Attorney, Agent, or Firm*—Quarles & Brady LLP

(57) ABSTRACT

A method using of a magnetic field to affect residual stress relief or phase transformations in a metallic material is disclosed. In a first aspect of the method, residual stress relief of a material is achieved at ambient temperatures by placing the material in a magnetic field. In a second aspect of the method, retained austenite stabilization is reversed in a ferrous alloy by applying a magnetic field to the alloy at ambient temperatures.

30 Claims, 3 Drawing Sheets

Magnetic Processing Using A 6 Tesla Field To Alter
The Residual Stresses In 52100 Alloy Steel Samples
(Y=Quenched & Tempered; N=Quenched & No Temper)

OTHER PUBLICATIONS

H. Conrad and A. F. Sprecher, "The Electroplastic Effect in Metals" in Dislocations in Solids, ed. F. R. N. Nabarro, vol. 8, chapter 43, Elsevier, Amsterdam 1989.

V. I. Alshits et al., "Magnetoplastic effect in non–magnetic crystals and internal friction", Journal of Alloys and Compounds, 211/212, pp. 549–553, 1994.

R. W. K. Honeycombe and H. K. D. H. Bhadeshia, in Steels: Microstructure and Properties, 2nd ed., John Wiley and Sons, Inc., p. 107, 1995.

Y. Fahmy et al., "Effects of Pulsed Magnetic Treatment on the Fatigue of Low Carbon Steel", Scripta Materialia, vol. 38, No. 9, pp. 1355–1358, 1998.

* cited by examiner

Magnetic Processing Using A 6 Tesla Field To Alter
The Residual Stresses In 52100 Alloy Steel Samples
(Y=Quenched & Tempered; N=Quenched & No Temper)

METHOD FOR RESIDUAL STRESS RELIEF AND RETAINED AUSTENITE DESTABILIZATION

STATEMENT REGARDING FEDERALLY SPONSORED RESEARCH

This invention was made with Government support under Contract No. DE-AC05-00OR22725 awarded to UT-Battelle, LLC, by the U.S. Department of Energy. The Government has certain rights in this invention.

CROSS-REFERENCES TO RELATED APPLICATIONS

Not Applicable.

BACKGROUND OF THE INVENTION

1. Field of the Invention

This invention relates to the use of a magnetic field to affect microstructural changes in a metallic material, first, by relieving residual stress at ambient or cryogenic temperatures and, second, in the case of ferrous alloys, by reversing retained austenite stabilization.

2. Description of the Related Art

Metal working procedures such as casting, forging, welding, heat-treating, and forming introduce residual stresses into components. FIG. 1 is a schematic describing the evolution of residual stresses and the unfavorable effects of residual stresses in components manufactured using prior art processes. Undesirable residual stresses in components are a major issue that many industries have to deal with. For example, the issues can be distortion during machining, cracking before tempering (stress relieving thermal treatments), or accelerated corrosion while in use.

Residual stresses are non-applied stress resulting from a constrained volume change. In metals, these stresses are elastic and are typically the direct result of elastic and plastic strains due to thermal gradient and phase transformation strains in addition to crystallographic anisotropy effects. Various stress relieving processes can cause movement of dislocations and relieve residual stresses through enhancing the mobility of the dislocation structure. This can lead to their rearrangement, multiplication, or annihilation, thereby altering the residual stress profile in a sample. Abatement of tensile residual stresses is very beneficial from both a component design and life expectancy viewpoint, since existing residual stresses typically reduce the design stresses and fatigue life. Residual stress relief is known by way of heat treatment in an oven, mechanical vibration, cryogenic treatment, or laser or annealing. U.S. Pat. Nos. 6,144,544 and 4,873,605, and Wu et al. in "Micromechanism of residual stress reduction by low frequency alternating magnetic field treatment", Materials Science and Engineering A328 133-136, 2002, also describe residual stress relief through the use of pulsed magnetic fields. However, these pulsed magnetic fields are generated by resistive electromagnet systems that rely on capacitors or other circuitry to pulse the magnetic field. Thus, these resistive magnet systems use large amounts of energy such that the processes are economically unattractive.

The use of either ac or dc electric or magnetic fields under certain exposure times and field intensities has also been proposed to partially repair high cycle fatigue damage as evidenced in some extension of fatigue life (see, for example, Conrad et al., Mater. Sci. Eng. A145, 1, 1991; Zhao et al., Eng. Fract. Mech. 46, 347, 1993; Fahmy et al., Scripta Mater. 38, 1355, 1998; Bhat et al., Int. J. Fatigue, 15, 193–197, 1993; and Bao-Tong et al., Scripta Mater. 40, 767, 1999). However, certain test conditions reported resulted in an opposite effect, i.e., a reduction in fatigue life occurred. This effect was not explained. The hypothesis suggested for the life improvement conditions was that accumulated fatigue damage (before the crack initiation stage) was eliminated or reduced during application of the electric or magnetic fields. The damage relieved in the early stages of fatigue in metals is the irreversible cyclic plastic deformation. This damage is observed in TEM studies of fatigued specimens as a developing dislocation substructure. The terms electroplasticity (see, H. Conrad and A. F. Sprecher, in Dislocations in Solids, ed. F. R. N. Nabarro, vol. 8, Elsevier, Amsterdam 1989) and magnetoplasticity (see, Alshits et al., J. Alloy Compd. 211/212, 549, 1994) have been presented in prior research studies where the presence of an electric current or magnetic fields appeared to reduce the plastic deformation resistance of metals resulting in the movement of dislocations without an external load.

Steel heat-treating processes can also produce retained austenite in a workpiece. Retained austenite is deleterious in many applications because this phase can transform subsequently upon the application of an external stress promoting high carbon martensite formation. This material is very brittle and can lead to catastrophic failure in service. Also, in high performance applications, where high-speed bearings are machined to very high tolerances, if the austenite transforms under load, seizing can occur and cause major system damage as a result of a large positive phase transformation volume strain (~4%).

Various industrial processes have been proposed to minimize retained austenite. FIG. 2 is a schematic showing two prior art processes for producing steel with minimal amounts of retained austenite. As the carbon level of steels is increased (>~0.5 wt. % carbon), the amount of transformation of austenite to martensite upon quenching is reduced as a result of processes that interfere with the nucleation and growth of the martensite plates that are the preferred microstructure. Typically, the martensite finish temperature, $M_F$, is below ambient temperature for these higher carbon alloys and so some untransformed austenite will exist under ambient conditions.

When cooling is resumed after some hold time at ambient temperature, the austenite to martensite transformation does not progress as far to completion as would have been accomplished if no isothermal hold had occurred. The amount of austenite stabilization that results generally is less the closer the isothermal arrest temperature is to the $M_S$ temperature, or stated a different way, the retained austenite is less when you have less martensite at the arrest temperature. An explanation for this is the fact that formation of the martensite plates leads to accommodating plastic deformation in the surrounding matrix. This can lead to very high dislocation densities in the austenite that can interact with the glissile dislocations in the martensite plate boundary and cause the martensite interface to no longer be mobile which will inhibit further growth of the martensite plate and stabilize the retained austenite.

Dislocation densities on the order of $10^{11}$–$10^{12}$ $cm^{-2}$ have been observed in these quenched steels in contrast to dislocation densities of $10^{6}$–$10^{8}$ $cm^{-2}$ for annealed microstructures. Subsequent migration of the interstitial carbon atoms to the dislocations (i.e., pinning) will further enhance the stabilization process, which explains why the degree of austenite stabilization is observed to increase to a maximum with time. This pinning of dislocations by carbon in ferrous martensites has been confirmed through internal friction measurements that reveal a Snoek peak in the internal friction intensity versus temperature plot, which occurs as a result of stress-induced movement of carbon atoms.

The presence of retained austenite upon quenching to room temperature is a major heat treatment concern since the heat treater must quickly move the quenched components to an alternate quench facility where cryogenic treatments must be performed to drive the transformation to completion (see prior art process #1 in FIG. 2). Generally, this additional processing step still leaves a residual amount of retained austenite. Alternately, multiple tempering heat treatments are employed to successively temper the initial martensite and form martensite from the retained austenite upon further cooling that must be re-tempered to transform the new martensite to the ferrite and carbide microstructure (see prior art process #2 in FIG. 2). The elimination of these additional heat treatment steps would result in energy savings and reduced greenhouse gases. In other prior processes, it has been proposed to control austenite formation by the application of magnetic field gradients to steel (see U.S. Pat. No. 5,885,370) or by the high temperature application of a magnetic field to steel (see U.S. Pat. No. 6,375,760).

Therefore, in view of the well known advantages of stress relieving processes and the advantages associated with reducing retained austenite in steel components, there is a continuing need for alternative processes for relieving residual stress in metals and for reversing retained austenite stabilization in ferrous alloys.

SUMMARY OF THE INVENTION

The foregoing needs are met by a method according to the invention for relieving residual stresses in a component formed from a metallic material and for affecting a phase transformation in a metallic material. In a first aspect, the invention provides a method for relieving residual stresses in a component formed from a metallic material wherein the method comprises applying a constant magnetic field of at least 1 Tesla to a metallic material at a temperature between about 10° C. and about 50° C. The first aspect of the invention is particularly useful in relieving residual stresses in a ferrous alloy or a ferromagnetic material.

In a second aspect on the invention, there is provided a method for affecting a phase transformation in a metallic material wherein a constant magnetic field of at least 1 Tesla is applied to a metallic material at a temperature between about 10° C. and about 50° C. The second aspect of the invention is particularly useful in affecting a phase transformation in a ferrous alloy or a ferromagnetic material.

In a third aspect on the invention, there is provided a method for affecting transformation of retained austenite to martensite in a ferrous alloy having martensite and retained austenite wherein a constant magnetic field of at least 1 Tesla is applied to a ferrous alloy having martensite and retained austenite at a temperature between about 10° C. and about 50° C. In one version of the third aspect of the invention, the ferrous alloy is thereafter placed in an environment having a temperature high enough to form tempered martensite. In another version of the third aspect of the invention, the ferrous alloy is thereafter placed in an environment having a transformation temperature low enough to transform any remaining portion of the retained austenite to martensite.

It is therefore an advantage of the present invention to provide a method for relieving residual stress in metals and for reversing retained austenite stabilization in ferrous alloys.

It is another advantage of the present invention to provide a method for relieving residual stress in metals and for reversing retained austenite stabilization in ferrous alloys that impacts a significant cross section of industry including casting, forging, forming, heat treating, steel, aluminum, and the industries that make use of metallic components It is a further advantage of the present invention to provide a method for relieving residual stress in metals and for reversing retained austenite stabilization in ferrous alloys that results in energy savings and the elimination of greenhouse gases from current heat treating processes.

It is yet another advantage of the present invention to provide a method for relieving residual stress in metals that allows for the tailoring of residual stress profiles for specific applications in fabricated components.

It is still another advantage of the present invention to provide a method for reversing retained austenite stabilization in ferrous alloys that eliminates tempering heat treatments to improve ductility by reducing the high dislocation density in quenched martensitic microstructures.

It is a still further advantage of the present invention to provide a method for relieving residual stress in metal components and for reversing retained austenite stabilization in ferrous alloys that enhances component life and performance through the elimination of undesirable residual stresses or the reduction of stabilized retained austenite that transforms to brittle martensite upon loading and reduces toughness that can lead to catastrophic failure.

It is still another advantage of the present invention to provide a method for relieving residual stress in metal components such that material and fabrication savings and reduced scrap will result through the residual stress relief because fabrication to near-net shape would become a reality for many industrial applications since residual stresses can be eliminated or significantly reduced before machining operations.

BRIEF DESCRIPTION OF THE DRAWINGS

These and other features, aspects, and advantages of the present invention will become better understood upon consideration of the following detailed description, appended claims, and drawings where:

DETAILED DESCRIPTION OF THE INVENTION

Figure 1:
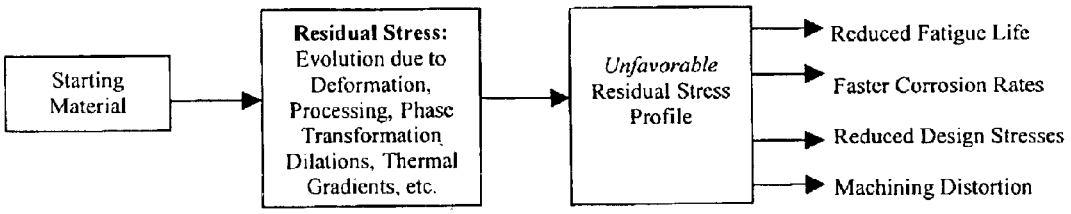
FIGURE 1 (PRIOR ART)
FIG. 1 is a schematic describing the evolution of residual stresses and the unfavorable effects of residual stresses in prior art processes.
Figure 2:
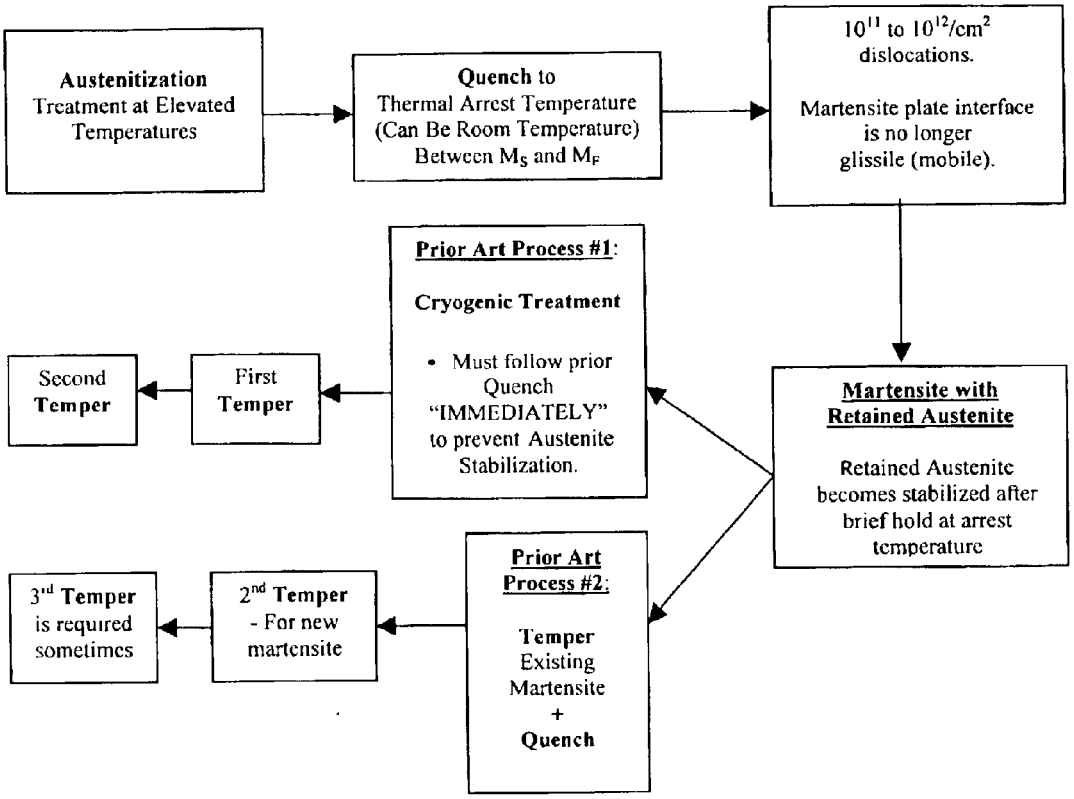
FIGURE 2 (PRIOR ART)
FIG. 2 is a schematic showing prior art processes for producing steel with minimal amounts of retained austenite.
Figure 3:
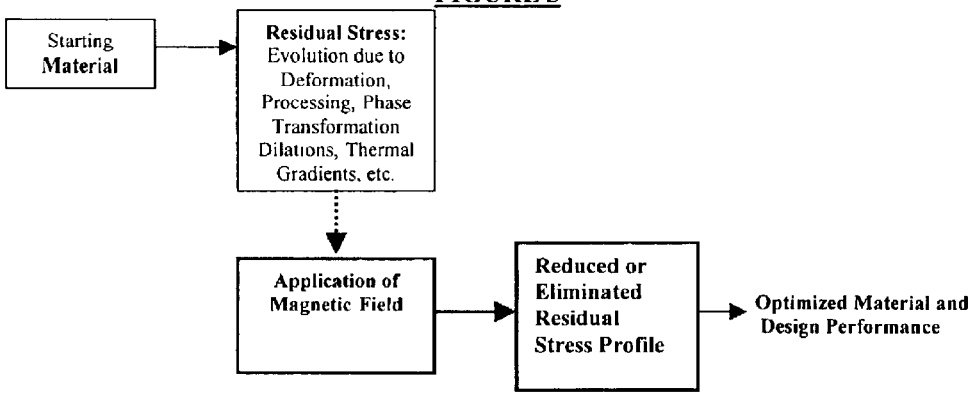
FIG. 3 is a schematic showing a method according to the invention for reducing or eliminating the residual stress profile in a material.

In a first aspect, the present invention provides a method for relieving residual stresses in a component formed from a metallic material. The method comprises applying a constant magnetic field of at least 1 Tesla to a metallic material at a temperature between about 10° C. (50° F.) and about 50°

C. (122° F.). Preferably, the magnetic field is 1–20 Tesla, and most preferably, the magnetic field is 2–10 Tesla. The magnetic field is applied to the metallic material having residual stresses for a time period sufficient to reduce residual stresses in the metallic material. For ferrous alloys, sufficient residual stress reductions can occur after the magnetic field has been applied for at least 0.5 hours.

The first aspect of the invention is suitable for relieving residual stresses in a component formed from a metallic material. Non-limiting examples of such metallic materials include: heat treatable aluminum alloys, copper alloys and any other heat-treatable precipitation hardening material; stainless steels; carbon and alloy steels; and any other metallic materials that experience a microstructural or phase transformation during cooling. The first aspect of the invention is particularly useful in relieving residual stresses in ferrous alloys and ferromagnetic materials. In particular, the first aspect of the invention is very advantageous in relieving residual stresses in quenched ferrous alloys having residual stresses due to phase transformation strains (e.g., an austenite to martensite transformation). Steels having at least 0.1 weight percent carbon are especially susceptible to residual stresses due to such phase transformation strains.

It has been discovered that a magnetic field generated by a superconducting magnet is advantageous for use in the first aspect of the invention. Superconducting magnets are now commercially available, and produce a constant field strength with essentially no energy consumption after being charged to the field strength. Thus, the stress relief provided by the first aspect of the invention can be achieved in an extremely energy efficient manner. The energy savings provided by the stress relief method of the first aspect of the invention can easily justify the cost of a superconducting magnet, particularly in continuous processing industrial applications such as a thermomechanical processing line of a steel mill. Also, the superconducting magnet provides a uniform magnetic field such that the metallic material can be placed at a location in the magnetic field where the magnetic field is uniform thereby eliminating gradient effects.

In a second aspect on the invention, there is provided a method for affecting a phase transformation in a metallic material wherein a constant magnetic field of at least 1 Tesla is applied to a metallic material at a temperature between about 10° C. and about 50° C. Non-limiting examples of such metallic materials include: heat treatable aluminum alloys, copper alloys and any other heat-treatable precipitation hardening material; stainless steels; and carbon and alloy steels; and any other metallic materials that experience a microstructural or phase transformation during cooling. Preferably, the magnetic field is 1–20 Tesla, and most preferably, the magnetic field is 2–10 Tesla. The magnetic field is applied to the metallic material for a time period sufficient to begin phase transformation process or to decrease the time for completion of the phase transformation. For ferrous alloys, a sufficient time period would be at least 0.5 hours.

In a third aspect on the invention, there is provided a method for affecting transformation of retained austenite to martensite in a ferrous alloy having martensite and retained austenite wherein a constant magnetic field of at least 1 Tesla is applied to a ferrous alloy having martensite and retained austenite at a temperature between about 10° C. and about 50° C. to transform at least a portion of the retained austenite to martensite. During the quenching of certain steels, retained austenite is produced along with martensite. In particular, high carbon alloys, such as those used in tool steels, have significant amounts of retained austenite as the austenite to martensite transformation does not go to completion.

Using the method of the third aspect on the invention, the transformation of at least a portion of the retained austenite to martensite can be affected at ambient temperatures (preferably between about 10° C. and about 50° C., most preferably between about 15° C. (59° F.) and about 30° C. (86° F.).) by applying a constant magnetic field of at least 1 Tesla to a ferrous alloy having martensite and retained austenite. Preferably, the magnetic field is 1–20 Tesla, and most preferably, the magnetic field is 2–10 Tesla. The magnetic field is applied to the ferrous alloy for a time period sufficient to begin the transformation of at least a portion of the retained austenite to martensite. Typically, a sufficient time period would be at least 0.5 hours.

Figure 4:
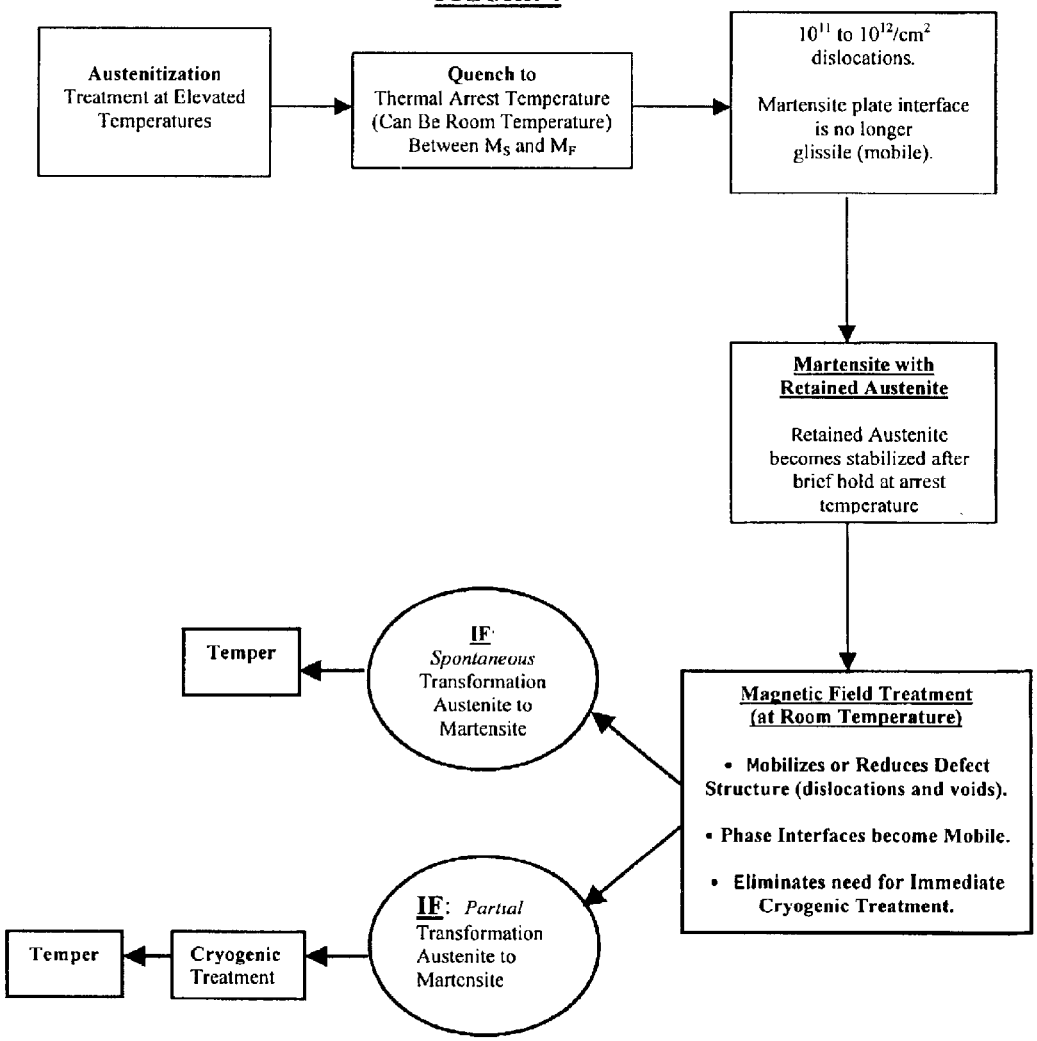
FIG. 4 is a schematic showing a method according to the invention for reducing or eliminating retained austenite in a steel.

As shown in FIG. 4, when the method provides for the spontaneous (i.e., substantially complete) conversion of the retained austenite in the ferrous alloy to martensite, the ferrous alloy may be thereafter placed in an environment having a tempering temperature high enough to form tempered martensite. Those skilled in the art are familiar with the selection of such a tempering temperature, and a tempering temperature of at least 150° C. (302° F.) is typically suitable.

Still referring to FIG. 4, when the method provides for the partial (i.e., not substantially complete) conversion of the retained austenite in the ferrous alloy to martensite, the ferrous alloy can be placed in an environment having a transformation temperature low enough to transform any remaining portion of the retained austenite to martensite. Those skilled in the art are familiar with the selection of such a transformation temperature, and cryogenic transformation temperatures below −70° C. (−94° F.) are useful in affecting the transformation of the remaining retained austenite to martensite. Non-limiting examples of cryogenic transformation treatments for steel alloys include: 24 hours at −190° C. (−310° F.); and 4 hours at −84° C. (−119° F.). After such cryogenic transformation treatments provide for conversion of the retained austenite in the ferrous alloy to martensite, the ferrous alloy may be thereafter placed in an environment having a tempering temperature high enough to form tempered martensite. Those skilled in the art are familiar with the selection of such a tempering temperature, and a tempering temperature of at least 150° C. is typically suitable.

Without intending to be bound by theory, it is believed that a magnetic field applied according to the invention achieves residual stress reduction and retained austenite destabilization through enhanced dislocation and solute mobility. Because residual stress is the direct result of plasticity (dislocation mechanisms), enhancing the mobility of the dislocation structure via the applied magnetic field leads to the annihilation of the dislocations and residual stress reduction. The applied magnetic fields also mobilize and eliminate the pinned dislocation networks responsible for partial stasis of the austenite transformation to martensite.

EXAMPLE

The following examples are intended only to further illustrate the invention and are not intended to limit the scope of the invention which is defined by the claims.

Example 1

In order to observe the effects of a magnetic field on residual stresses and retained austenite, magnetic field processing was undertaken using a 6 Tesla system. Experiments were conducted using a commercial grade of 52100-alloy steel. Because of the high carbon content of this alloy, significant residual stresses and some retained austenite are generated upon quenching to ambient temperatures. Therefore, this alloy was deemed to be an excellent candidate to show the potential benefits of applying a magnetic for the purpose of relieving residual stress or reversing the stabilization of retained austenite that occurs at room temperature before initiating a cryogenic quench. Also, prior research efforts have been conducted on this material to study phase transformation kinetics through dilatometry and to measure residual stresses using neutron diffraction techniques. Therefore, experimental methods for measuring residual stress and retained austenite already have been successfully demonstrated on this alloy.

Microstructural characterizations and residual stress profiling were performed. Two rounds of experiments were conducted in the course of the investigation on 52100 alloy steel specimens. The composition of these specimens on a weight percent basis was determined through chemical analyses to be: 1.04 C, 0.38 Mn, 0.28 Si, 1.42 Cr, 0.16 Ni, 0.08 Mo, 0.18 Cu, 0.05 Al, 0.024 P, and 0.021 S.

An X-ray synchrotron was selected as one analytical tool in order to provide mechanistic evidence of the effects of the magnetic field on samples. The synchrotron can quantify in real time the residual stress evolution in a sample, the dislocation density, the presence or evolution of $\eta$ or $\epsilon$ carbides, any changes in the tetragonality of the martensite phase (measure $I_{112}/I_{121}+I_{211}$) showing carbon migration, and the development of any coherent structural modulations (spinodal decomposition).

Initially, experimental data for residual stress were generated using the Brookhaven X-ray synchrotron X14A Beamline on induction hardened bar samples. Induction hardening is a typical industrial process used on this alloy to produce camshafts. However, the residual stress results indicated significant inhomogeneity in the surface measurements. These specimens were rejected for further evaluation and exposure to the magnetic field processing since this initial variation was considered too inconsistent for subsequent evaluation and meaningful conclusions. Therefore, a second set of 6 bar specimens was fabricated and given a conventional batch furnace austenitization heat treatment and immersion quench in hot oil. The cylindrical specimens were 25.4 mm. in diameter and 101.6 mm. long. The specific heat treatment cycle was as follows. In 10 minutes, the samples were raised from ambient temperature to 650° C. and held for 20 minutes, then ramped up to 830° C. in 10 minutes and held for 2 hours. The specimens were subsequently immersion quenched in hot oil held at 85° C. before being cooled down to room temperature. This treatment was selected since it would produce the tensile residual stresses and retained austenite as needed for the study.

Figure 5:
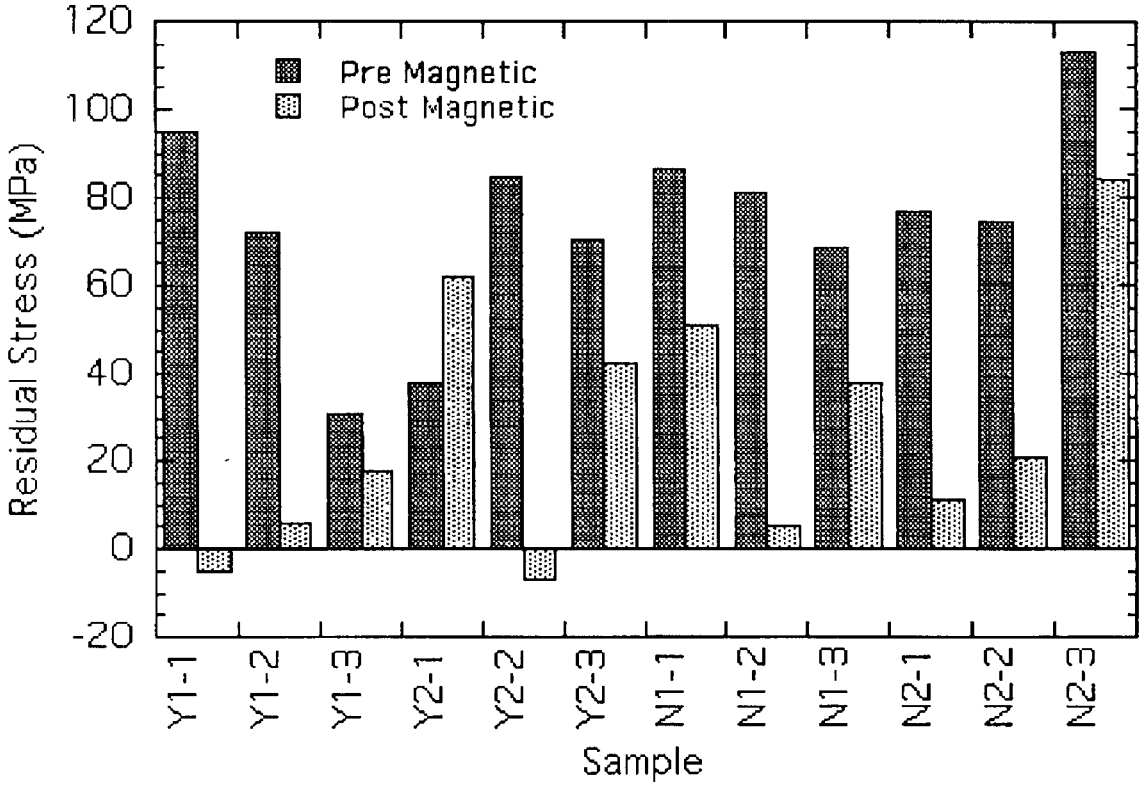
FIG. 5 is a graph showing the results of magnetic processing using a 6 Tesla magnetic field to alter the residual stresses in 52100 alloy steel samples.

Half of the quenched specimens were given a subsequent temper treatment to partially relieve some of these residual stresses and transform the residual retained austenite to martensite. This latter set were designated "Y" to indicate their quenched and (Yes) tempered condition, while the former untempered samples were designated "N" for quenched—No temper. The designations are shown in FIG. 5 which will be discussed below. The temper cycle employed was for 2 hours between 175° C. and 190° C.

The initial surface axial residual stresses and percent retained austenite for all of the samples were measured using a TEC x-ray diffractometer at three specific circumferential points 120 degrees apart at the circular midplane of the samples 50.8 mm. from the flat ends of the samples. Therefore, in the plots of these data (FIG. 5) there are 3 values shown for each sample to indicate each of the 3 circumferential values per sample; e.g., Y1-1, Y1-2, and Y1-3 for sample Y1. Chrome K$\alpha$ radiation was used. A $\sin^2\psi$ analysis was employed on the martensitic (211) reflection. Further, the volume fraction of retained austenite was determined via a modified analysis version of that defined in the ASTM E975-95 specification.

After the initial data were collected on all 6 of the pre magnetically processed samples, 2 specimens from each lot "Y" and "N" with the most uniform initial residual stress profiles were exposed to a 6 Tesla magnetic field in a Cryomagnetics, Inc superconducting magnet system. A special fixture to hold these specimens was designed and fabricated out of 316L stainless steel to facilitate holding these samples exactly in the central bore region of the superconducting magnet. The magnetic field was most uniform at this location eliminating gradient effects. Specimens Y1 and N1 were placed in the magnet system at 0 initial field strength as a safety precaution to eliminate any sample handling and insertion concerns for the experiments. After sealing off the bore region with a 316 L stainless steel plate, the magnetic field was subsequently ramped up to 6 Tesla and held for 1 hour before being slowly discharged to 0 Tesla (~1 hour) for safe sample removal. Samples Y2 and N2 received 4-hour exposures at 6 Tesla using a similar test cycle. All 4 magnetically processed samples exhibited remnant magnetization after their cycles with the non-tempered samples (N) qualitatively having greater remnant magnetization than the tempered (Y) samples. After completing the magnetic processing experiments, each lot of specimens was clustered together with their untreated counterpart and sent to a TEC residual stress facility to measure residual stresses and retained austenite on all 6 samples.

Results of Example 1

The results of the experiments of Example 1 that compare pre- and post-magnetic processing values of residual stress are indicated in FIG. 5. Experimental error for the residual stress measurements is estimated to be ±25 MPa. The data in FIG. 5 indicate that magnetic processing reduces the magnitude of the quenched-in residual stresses.

Thus, it can be seen that the magnetic processing of steel samples will alter the surface residual stress values developed as a result of an austenitization and quench heat treatment. This was accomplished by showing that tensile residual stresses were reduced after exposure to a magnetic field intensity of 6 Tesla. The ramifications of this result are extraordinary from both a part life extension and design allowable stress perspective. Components that have induced tensile residual stresses from a fabrication or application environment perspective can have those stresses mitigated by the application of a modest magnetic field thereby extending part life expectancy or increasing the application design stresses. The latter is attractive from a weight and energy savings perspective since more design efficient components can be made for existing materials and applications. It is contemplated that lower field strengths than 6 Tesla can achieve the results demonstrated herein.

Although the present invention has been described in considerable detail with reference to certain embodiments, one skilled in the art will appreciate that the present invention can be practiced by other than the described embodiments, which have been presented for purposes of illustration and not of limitation. For example, alternate versions of this invention would be to use this technology for generic materials processing applications where deformation or residual stress occurs. For example, this invention can have an impact in deformation processing where intermediate annealing heat treatments are required after specific amounts of deformation to prevent cracking due to too high an accumulation of a deformation microstructure during each step. This invention can eliminate the need for these intermediate annealing heat treatments by restoring ductility through "in-situ" application of the electric/magnetic field concept during the deformation operation. This would allow the elimination of multiple deformation processing and heat treatment cycles. This invention can be used to replace intermediate elevated temperature annealing heat treatments. The invention may facilitate the development of superplastic behavior (achievement of hundreds of percent elongation normally at high temperatures) in materials that normally do not exhibit this effect or possibly induce this effect at room temperature. Also, some metal deformation processing conditions are limited for steels due to serrated yielding, which can be eliminated with this invention. When the highly strained microstructure in as-quenched martensitic microstructure steels is reduced with this invention, conventional tempering operations to improve ductility can be eliminated and replaced with the application of the magnetic field process at room temperature to reduce the very high dislocation density defect structure and promote carbon atom diffusion that would be similar to the mechanism involved in conventional tempering. Therefore, the scope of the appended claims should not be limited to the description of the embodiments contained herein.

What is claimed is:

1. A method for relieving residual stresses in a component formed from a metallic material, the method comprising:

applying a constant magnetic field of at least 1 Tesla to a metallic material having residual stresses at a temperature between about 10° C. and about 50° C. thereby relieving the residual stresses in the metallic material.

2. The method of claim 1 wherein:

the magnetic field is 1–20 Tesla.

3. The method of claim 1 wherein:

the magnetic field is 2–10 Tesla.

4. The method of claim 1 wherein:

the magnetic field is applied for at least 0.5 hours.

5. The method of claim 1 wherein:

the metallic material is a ferrous alloy.

6. The method of claim 1 wherein:

the metallic material is a ferromagnetic material.

7. The method of claim 1 wherein:

the metallic material is placed at a location in the magnetic field where the magnetic field is uniform thereby eliminating gradient effects.

8. The method of claim 1 wherein:

the metallic material is a quenched ferrous alloy.

9. The method of claim 1 wherein:

the metallic material is a steel having at least 0.1 weight percent carbon.

10. The method of claim 1 wherein:

the magnetic field is generated by a superconducting magnet.

11. A method for affecting a phase transformation in a metallic material, the method comprising:

applying a constant magnetic field of at least 1 Tesla to a metallic material at a temperature between about 10° C. and about 50° C. thereby affecting a phase transformation in the metallic material.

12. The method of claim 11 wherein:

the magnetic field is 1–20 Tesla.

13. The method of claim 11 wherein:

the magnetic field is 2–10 Tesla.

14. The method of claim 11 wherein the method decreases the time for completion of the phase transformation.

15. A method for affecting transformation of retained austenite to martensite in a ferrous alloy having martensite and retained austenite, the method comprising:

applying a constant magnetic field of at least 1 Tesla to a ferrous alloy having martensite and retained austenite at a temperature between about 10° C. and about 50° C. to transform at least a portion of the retained austenite to martensite.

16. The method of claim 15 further comprising:

placing the ferrous alloy in an environment having a tempering temperature high enough to form tempered martensite after applying the magnetic field.

17. The method of claim 16 wherein:

the tempering temperature is at least 150° C.

18. The method of claim 15 further comprising:

placing the ferrous alloy in an environment having a transformation temperature low enough to transform any remaining portion of the retained austenite to martensite after applying the magnetic field.

19. The method of claim 18 wherein:

the transformation temperature is below −70° C.

20. The method of claim 18 further comprising:

placing the ferrous alloy in an environment having a tempering temperature high enough to form tempered martensite after placing the ferrous alloy in the environment having the transformation temperature.

21. The method of claim 20 wherein:

the tempering temperature is at least 150° C.

22. The method of claim 15 wherein:

the magnetic field is 1–20 Tesla.

23. The method of claim 15 wherein:

the magnetic field is 2–10 Tesla.

24. The method of claim 15 wherein:

the magnetic field is applied for at least 0.5 hours.

25. The method of claim 15 wherein:

the magnetic field is applied at a temperature between about 15° C. and about 30° C.

26. A method for relieving residual stresses in a component formed from a metallic material, the method comprising:

applying a constant magnetic field of at least 1 Tesla to a metallic material having residual stresses at a temperature between about 10° C. and about 50° C., wherein the magnetic field is 2–10 Tesla.

27. A method for relieving residual stresses in a component formed from a metallic material, the method comprising:

applying a constant magnetic field of at least 1 Tesla to a metallic material having residual stresses at a temperature between about 10° C. and about 50° C., wherein the magnetic field is applied for at least 0.5 hours.

28. A method for relieving residual stresses in a component formed from a metallic material, the method comprising:

applying a constant magnetic field of at least 1 Tesla to a metallic material having residual stresses at a temperature between about 10° C. and about 50° C., wherein the metallic material is a quenched ferrous alloy.

29. A method for relieving residual stresses in a component formed from a metallic material, the method comprising:

applying a constant magnetic field of at least 1 Tesla to a metallic material having residual stresses at a temperature between about 10° C. and about 50° C., wherein the metallic material is a steel having at least 0.1 weight percent carbon.

30. A method for relieving residual stresses in a component formed from a metallic material, the method comprising:

applying a constant magnetic field of at least 1 Tesla to a metallic material having residual stresses at a temperature between about 10° C. and about 50° C., wherein the magnetic field is generated by a superconducting magnet.

* * * * *